United States Patent [19]

Ohmura et al.

[11] 4,202,686

[45] May 13, 1980

[54] PROCESS FOR MANUFACTURING FINE POWDER OF METAL

[75] Inventors: Taizo Ohmura, Ohmiya; Noboru Yonezawa, Urawa; Kazuo Ikuta, Kawagoe, all of Japan

[73] Assignee: Mitsubishi Kinzoku Kabushiki Kaisha, Tokyo, Japan

[21] Appl. No.: 857,886

[22] Filed: Dec. 6, 1977

[30] Foreign Application Priority Data

Dec. 27, 1976 [JP] Japan ..... 51-156469
Apr. 23, 1977 [JP] Japan ..... 52-46350

[51] Int. Cl.[2] ..... B22F 1/02
[52] U.S. Cl. ..... 75/0.5 B; 75/0.5 BC
[58] Field of Search ..... 75/0.5 B, 0.5 BA, 0.5 BB, 75/0.5 BC

[56] References Cited

U.S. PATENT DOCUMENTS

| | | | |
|---|---|---|---|
| 1,993,598 | 3/1935 | DeBats | 75/0.5 BC |
| 2,037,672 | 4/1936 | Zeiss | 75/0.5 B |
| 2,396,101 | 3/1946 | Hensel et al. | 75/0.5 BC |
| 3,036,938 | 5/1962 | Hudson | 75/0.5 B |
| 3,652,259 | 3/1972 | Knopp | 75/0.5 B |

*Primary Examiner*—W. Stallard
*Attorney, Agent, or Firm*—Frishauf, Holtz, Goodman & Woodward

[57] ABSTRACT

A metal in a molten state, which is to be pulverized, is put in a vessel in coexistence with an assistant-powder consisting of a material which has a higher melting point than said metal and is difficult to chemically react with said metal and/or difficult to form a solid solution with said metal. Then, said molten metal and said assistant-powder are mixed thoroughly by stirring. Then, while continuing said stirring, said molten metal and said assistant-powder are slowly cooled until the temperature of the former reaches at least its solidus point to pulverize said metal into a fine powder and to form a composite powder having a structure in which said assistant-powder adheres to said fine powder to cover the entire surface of each particle of said fine powder. And then, said assistant-powder is separated and removed from said composite powder, thereby obtaining a fine powder of said metal.

28 Claims, 1 Drawing Figure

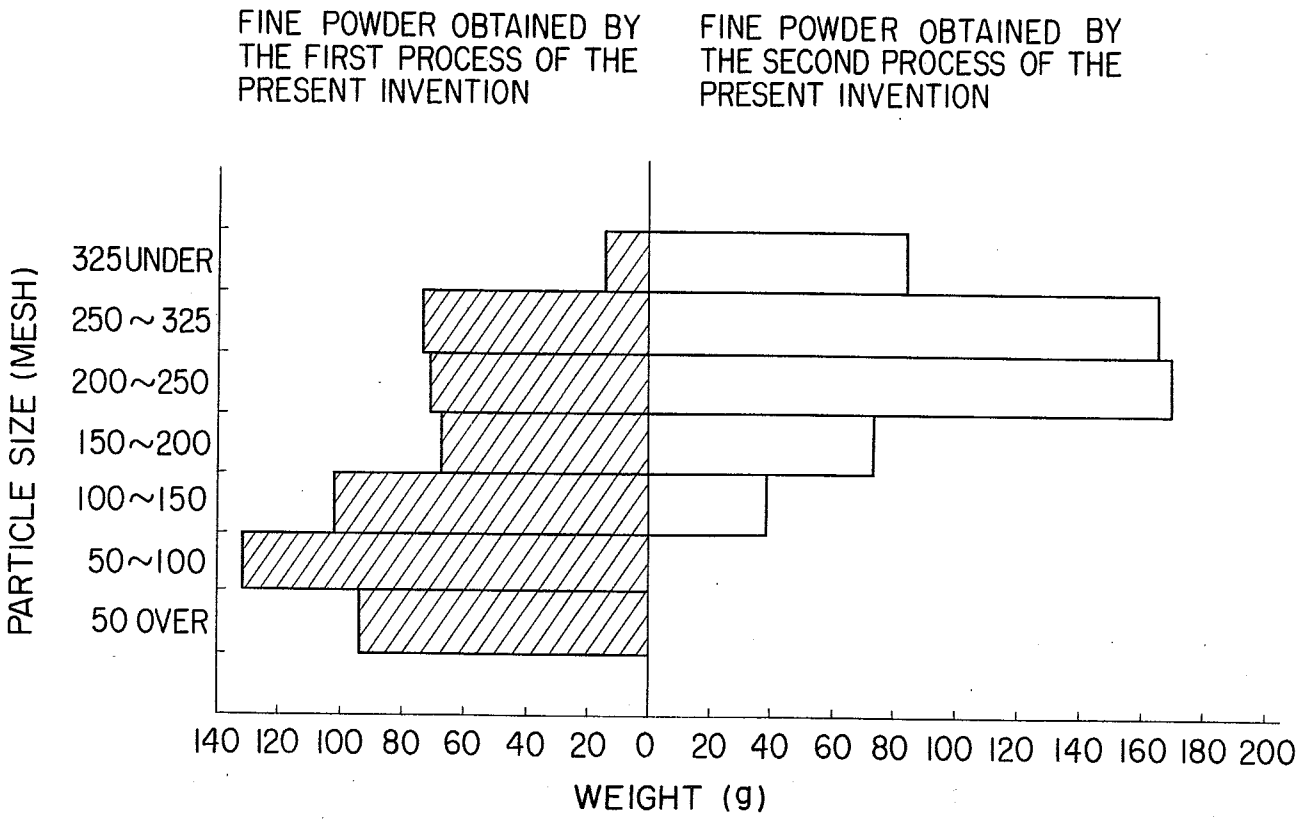
FINE POWDER OBTAINED BY THE FIRST PROCESS OF THE PRESENT INVENTION
FINE POWDER OBTAINED BY THE SECOND PROCESS OF THE PRESENT INVENTION
325UNDER
250 ~ 325
200~250
150~200
100~150
50~100
50 OVER
PARTICLE SIZE (MESH)
140 120 100 80 60 40 20 0 20 40 60 80 100 120 140 160 180 200
WEIGHT (g)

PROCESS FOR MANUFACTURING FINE POWDER OF METAL

REFERENCE TO PATENTS, APPLICATIONS AND PUBLICATIONS PERTINENT TO THE INVENTION

So far as we know, there are no patents, patent applications and publications pertinent to the present invention.

FIELD OF THE INVENTION

The present invention relates to a process for manufacturing a fine powder of a pure metal or an alloy.

BACKGROUND OF THE INVENTION

A fine powder of a pure metal or an alloy is used as a material for a sintered alloy, an additive for metal refining, an additive for a paint, a material for fillers for a plate grid of a battery and in a wide variety of other applications.

Heretofore, many processes for manufacturing a fine powder of a pure metal or an alloy (hereinafter generally referred to as "metal") are known, but among these, the mechanical pulverizing process, the molten metal pulverizing process, the reduction process and the electrolytic process have been put into practical use in an industrial scale. Particularly, the molten metal pulverizing process is widely applied because of the capability of pulverizing a metal more easily and more easily and more efficiently than the pulverization of a solid metal.

The molten metal pulverizing process has however a disadvantage in that it is difficult to manufacture a fine powder because of the very short time for pulverization of molten metal. This process may roughly be classified into the following three types:

(a) The shotting process which comprises dripping a molten metal in the form of droplets into water through a small hole and solidifying said molten droplets by cooling thereby granulating said molten metal;

(b) The graining process which comprises cooling and solidifying a molten metal while intensively stirring in the atmosphere and utilizing the oxidization of said metal during this period, thereby granulating said molten metal;

(c) The atomizing process which comprises causing a molten metal to flow out through a small hole in the form of a tiny stream, applying a water jet or a centrifugal force to said stream to finely disperse said molten metal and simultaneously cool and solidify said dispersion, thereby granulating said molten metal.

The shotting process described in (a) above is used principally for the granulation of lead, tin, zinc, aluminum, copper and copper alloys. A metal powder obtained by this process comprises coarse shots having the shape of spheres or drops, and it is difficult by this process to manufacture a powder with a particle size of up to 1 mm.

The graining process described in (b) above is used principally for the granulation of zinc and aluminum. A metal powder obtained by this process comprises relatively coarse grains having an irregular or drop shape with their surfaces covered with oxides, and most of the grains fall into a particle size range of from about 20 to about 100 mesh (from about 833 to about 147 μm).

The atomizing process described in (c) above is applied for the pulverization of almost all metals other than those particularly susceptible of oxidation and with an extremely high melting point. With this process, it is possible, under appropriately selected conditions, to manufacture a metal powder with any of various shapes such as sphere and drop as well as with any of various grain sizes ranging from a fine powder of several tens of μm to a relatively coarse powder of several hundreds of μm. However, the surfaces of the metal powder particles obtained by this process are often covered with oxides, and in addition, the molten metal tends to cool and solidify rapidly because of the high cooling ability of the atomizing medium. As a result, the atmospheric gas either entrained into the metal powder or dissolved in the molten metal is relieved not completely during the solidification of the molten metal, thereby often causing pores in the metal powder obtained.

Also, a metal powder obtained by the mechanical pulverizing process using such an equipment as a ball mill hardens because of the residual strain remaining in it and inevitably contains impurities mixed in it. In this process, furthermore, the metal powder obtained takes the form of either fish scale, flat plate or dish, and hence, it is difficult to manufacture a metal powder having a uniform shape and grain size and it takes much time for pulverization.

A metal powder obtained by the reduction or electrolytic process is poor in fluidity as it presents a dendritic shape and is not suitable for use as the material for sintered alloys based on the powder metallurgy process.

SUMMARY OF THE INVENTION

The principal object of the present invention is therefore to provide a process for manufacturing a fine powder of a metal having spherical or various irregular shapes, being free from pores and surface oxidization, and having relatively uniform particle sizes.

Another object of the present invention is to provide a process which permits manufacture of a fine powder of a metal efficiently by easy operations and at lower costs.

In accordance with one of the features of the present invention, there is provided a process for manufacturing a fine powder of metal which comprises the steps of:

putting a metal in at least a semi-molten state, which is to be pulverized, in a vessel in coexistence with an assistant-powder, said assistant powder consisting of a material which has a higher melting point than said metal and is difficult to chemically react with said metal and/or difficult to form solid solution with said metal, and the temperature of said at least semi-molten metal being lower than the melting point of said assistant-powder;

mixing said at least semi-molten metal and said assistant-powder by stirring so as to ensure uniform dispersion of said assistant-powder in said at least semi-molten metal;

slowly cooling said at least semi-molten metal and said assistant-powder, while continuing said stirring, until the temperature of said at least semi-molten metal reaches at least its solidus point, to pulverize said metal into a fine powder and to form a composite powder having a structure in which said assistant-powder adheres to said fine powder to cover the entire surface of each particle of said fine powder; and then, separating and removing said assistant-powder from said composite powder, thereby obtaining a fine powder of said metal.

BRIEF DESCRIPTION OF THE DRAWING

The FIGURE is a graph showing the grain size distribution of a fine powder of a metal obtained by the first and the second processes of the present invention.

DETAILED DESCRIPTION OF PREFERRED EMBODIMENTS

We have conducted an intensive study to solve the aforementioned problems involved in the conventional processes for manufacturing a fine powder of a metal. As a result, we have found that it is possible to manufacture a fine powder of a metal having spherical or various irregular shapes and having excellent properties free from pores and surface oxidization and having relatively uniform particle sizes, efficiently and at lower costs by simple operations by the steps of:

putting a metal in a molten or semi-molten state, which is to be pulverized, in a vessel in coexistence with an assistant-powder consisting of a material which has a higher melting point than said metal and is difficult to chemically react with said metal and/or difficult to form a solid solution with said metal;

mixing said molten or semi-molten metal and said assistant-powder by stirring so as to ensure uniform dispersion of said assistant-powder in said molten or semi-molten metal;

slowly cooling said molten or semi-molten metal and said assistant-powder, while continuing said stirring, until the temperature of said molten or semi-molten metal reaches at least its solidus point, to pulverize said metal into a fine powder and to form a composite powder having a structure in which said assistant-powder adheres to said fine powder to cover the entire surface of each particle of said fine powder, and then, separating and removing said assistant-powder from said composite powder, thereby obtaining a fine powder of said metal.

The process for manufacturing a fine powder of a metal comprising the steps described above is referred to as "the first process" of the present invention.

In the first process of the present invention, a metal in a molten or semi-molten state, which is to be pulverized, is put in a vessel in coexistence with an assistant-powder to be described later by any of the following steps:

(a) Charging a solid metal to be pulverized into a vessel, heating said metal until said metal reaches at least a semi-molten state (i.e., a state in which solid and liquid phases are coexisting), and then, adding an assistant-powder to said metal in at least a semi-molten state; or (b) Charging a solid metal to be pulverized into a vessel together with an assistant-powder, and then heating said metal and said assistant-powder until said metal reaches at least a semi-molten state; or (c) Charging a previously prepared metal to be pulverized in a molten or semi-molten state into a vessel, and then, adding an assistant-powder to said molten or semi-molten metal; or (d) Following the steps of melting and refining a metal to be pulverized in a vessel, adding an assistant-powder to said metal still in at least a semi-molten state in the vessel.

The assistant-powder to be used in the first process of the present invention must consist of a material which has a higher melting point than a metal to be pulverized and is difficult to chemically react with said metal and/or difficult to form a solid solution with said metal. As the assistant-powder mentioned above, at least one powder is used, depending upon the kind of the metal to be pulverized, which is appropriately selected from the group consisting of:

(a) Powders of such oxides as MgO, $Al_2O_3$, $Al_2Si_2O_7$ (Kaolinite), $SiO_2$, CaO, $TiO_2$, $Cr_2O_3$, MnO, $Fe_3O_4$, $CoO.2Al_2O_3$, $Cu_2O$, ZnO, SrO, $ZrO_2$, CdO, $SnO_2$, $Sb_2O_3$, Bao, $La_2O_3$, $CeO_2$, PbO and $Pb_3O_4$;

(b) Powders of such carbides as $B_4C$, TiC, ZrC, TaC and WC;

(c) Powders of such nitrides as BN, AlN, $Si_3N_4$ and TiN;

(d) Powders of such carbonitrides as Ti(CN) and such carbonitride oxides as Ti(CNO);

(e) Powders of such sulfides as CaS, ZnS, CdS, xCdS.yCdSe and $Sb_2S_3$;

(f) Powders of such borides as $AlB_2$, $Fe_2B$, $Ni_2B$ and NbB; and (g) Powders of such carbons as black carbon and graphite.

When said assistant-powder has a particle size of under about 0.001 μm, it scatters about in the form of dust, and this is not desirable for handling and health of workers. If its particle size exceeds about 10 μm, good results cannot be obtained in pulverizing a metal. It is therefore desirable to keep the particle size of said assistant-powder within a range of from about 0.001 to about 10 μm.

Furthermore, the temperature of said molten or semi-molten metal must be lower than the melting point of the aforementioned assistant-powder coexisting with said metal.

Then, in the first process of the present invention, said molten or semi-molten metal and said assistant-powder contained in the vessel are mixed by stirring so as to ensure uniform dispersion of said assistant-powder in said molten or semi-molten metal.

The ratio of the assistant-powder to the metal to be pulverized is largely dependent on the kind of said metal and the particle size of said assistant-powder, and cannot therefore be generalized. However, it is necessary to use the assistant-powder in an amount sufficient to cover the entire surface of each of fine powder particles of the metal pulverized as described later. For instance, when the metal to be pulverized is aluminum (Al) and the particle size of the assistant-powder ranges from about 0.1 to about 1 μm, it is desirable to use the assistant-powder in an amount of over about 5 wt.% of said Al; and when the metal to be pulverized is copper (Cu) and the particle size of the assistant-powder ranges from about 0.001 to about 0.006 μm, the amount of said assistant-powder should preferably be over about 2 wt.% of said Cu.

The aforementioned stirring may be achieved by mechanically or electromagnetically rotating or oscillating stirrer blades, or by mechanically or electromagnetically rotating or oscillating the vessel, or by a combination of these conventionally known means. Since the extent of said stirring is also influenced by the viscosity and volume of a molten or semi-molten metal to be pulverized as well as by the shape and size of the vessel and the stirrer blades, it is impossible to present one generally applicable extent of stirring. However, in the case where the stirring is carried out with a stirrer blade comprising a single plate, said stirrer blade may be rotated at a rate of at least about 100 r.p.m., or if the stirring is carried out by the oscillation of the vessel, it suffices to oscillate said vessel at a rate of at least about 100 times per minute.

Then, in the first process of the present invention, said molten or semi-molten metal and said assistant-powder are cooled slowly while continuing said stirring. It suffices to carry out said cooling until the temperature of said molten or semi-molten metal reaches its solidus point. It is also desirable to carry out said cooling at a slow rate within a range of from 0.1° to 10° C. per minute in order to fully pulverize said molten or semi-molten metal, into a fine powder.

As a result of the above-mentioned stirring and slow cooling, said molten or semi-molten metal is fully pulverized into a fine powder and there is formed a composite powder having a structure in which said assistant-powder adheres to said fine powder to cover the entire surface of each particle of said fine powder of said metal, said fine powder showing a wide range of particle size distribution of from about 10 to about 325 mesh (from about 1,651 to about 44 μm), (there are naturally some finer particles of under 325 mesh). After the formation of said composite powder, it is desirable to prevent cohesion and sintering of said composite powder by transferring it to another vessel for rapid cooling.

It is also desirable in the first process of the present invention to carry out the aforesaid steps from the melting of said metal to the completion of its pulverization in a non-oxidizing atmosphere so that oxidation of said molten or semi-molten metal as well as of the fine powder of said metal produced may be avoided.

Subsequently, in the first process of the present invention, said assistant-powder is separated and removed from said composite powder by means of an appropriate conventionally known step. For instance, said assistant-powder may be separated from each surface of said fine powder particles of said metal by applying ultrasonic cleaning to said composite powder in a non-oxidizing solution such as acetone and alcohol, and then removed through gravity concentration or elutriation, or said assistant-powder may be separated and removed by floatation or electrostatic selection, thereby obtaining a fine powder of said metal as desired.

According to the aforementioned first process of the present invention, it is certainly possible to manufacture, by simple operations with a high efficiency and at lower costs, a fine powder of a metal which has spherical or various irregular shapes, shows a wide particle size distribution ranging from about 10 to about 325 mesh (from about 1,651 to about 44 μm) (there are of course present some finer particles of under 325 mesh), and has excellent properties free from surface oxidization and pores. In the first process of the present invention, however, it is difficult to manufacture in a stable manner a fine powder of a metal which has relatively uniform and very small particle sizes and shows a tight particle size distribution mostly ranging from about 200 to about 325 mesh (from about 74 to about 44 μm).

Conventionally, it is the usual practice to manufacture a fine powder of a metal, which has relatively uniform and very small particle sizes and shows a tight particle size distribution mostly ranging from about 200 to about 325 mesh as mentioned above, principally by the mechanical pulverization process or by the atomizing process. However, these conventionally known processes present many drawbacks as described previously.

We have therefore carried out intensive studies to find a process for manufacturing a fine powder of a metal which has further smaller particle sizes and shows a tighter particle size distribution than the fine powder of a metal obtained by the first process of the present invention described above. We have as a result found that it is possible to obtain a fine powder of a metal, which has further smaller particle sizes and shows a tighter particle size distribution than the fine powder of a metal obtained by the first process of the present invention, by employing, as the starting material, previously prepared spherical, granular or powdery metal and by pulverizing said metal under the action of an assistant-powder, whereas, in the first process of the present invention, a molten or semi-molten metal is used as the starting material and is pulverized under the action of an assistant-powder. The process comprising the steps for manufacturing a fine powder of a metal described in detail below in hereinafter referred to as "the second process" of the present invention.

In the second process of the present invention, there is employed, as the starting material, a fine powder of a metal obtained by the first process of the present invention, a spherical, granular or powdery metal obtained by any of such conventionally known processes as the mechanical pulverizing process, molten metal pulverizing process, reduction process and electrolytic process, or generated metal scrap such as cutting scrap and dust (hereinafter generally referred to as "micrometal").

Assistant-powders used in the second process of the present invention and conditions to be met by such assistant-powders are the same as the assistant-powders used in the first process of the present invention and the conditions to be met by said assistant-powders.

In the second process of the present invention, a micro-metal to be pulverized is charged first into a vessel together with at least one assistant-powder appropriately selected depending upon the kind of said metal, just as in the first process of the present invention.

Then, in the second process of the present invention, said micro-metal and said assistant-powder are stirred so as to ensure uniform mixing of said micro-metal and said assistant-powder charged in said vessel. The means and the extent of said stirring may be the same as those applied in the first process of the present invention.

The ratio of the assistant-powder to the micro-metal to be pulverized, depending upon the kind of said metal and the particle size of said assistant-powder, cannot be generalized. However, the particle size of a fine powder of metal obtained by the second process of the present invention is smaller than the particle size of a fine powder of a metal obtained by the first process of the present invention. Therefore, the total surface area of the former fine powder is larger than the total surface area of the latter fine powder relative to the same volume. It is therefore necessary to use, in the second process of the present invention, a larger amount of assistant-powder than in the first process of the present invention. For example, in the case where the micro-metal to be pulverized is aluminum (Al), and the particle size of the assistant-powder ranges from about 0.1 to about 1 μm, it is desirable to use the assistant-powder in an amount of over about 9 wt.% of said Al; and in the case where the micro-metal to be pulverized is copper (Cu), and the particle size of the assistant-powder ranges from about 0.001 to about 0.006 μm, it is desirable to use the assistant-powder in an amount of over 3 wt.% of said Cu.

Then, in the second process of the present invention, said micro-metal and said assistant-powder are heated, while continuing said stirring, until said micro-metal reaches the molten or semi-molten state. The means for said heating may be the same as that used in the first process of the present invention. The temperature of said micro-metal heated to the molten or semi-molten state should be lower than the melting point of said assistant-powder. Because said assistant-powder is present uniformly and thoroughly between the particles of said micro-metal, particles of said molten or semi-molten micro-metal never agglomerate together and grow into larger particles even after said micro-metal has reached the molten or semi-molten state.

Then, in the second process of the present invention, said molten or semi-molten micro-metal and said assistant-powder are cooled slowly while continuing the aforementioned stirring. It suffices to conduct said cooling until the temperature of said molten or semi-molten micro-metal reaches its solidus point. Conditions for said cooling are the same as the cooling conditions in the first process of the present invention: it is desirable to carry out said cooling at a slow cooling rate within a range of from 0.1° to 10° C. per minute, in order to fully pulverize said molten or semi-molten micro-metal into a fine powder.

As a result of the aforementioned stirring and slow cooling, said molten or semi-molten micro-metal is fully pulverized into a fine powder and there is formed a composite powder having a structure in which said assistant-powder adheres to said fine powder to cover the entire surface of each particle of said fine powder of said metal, said fine powder showing a tight particle size distribution mostly ranging from about 200 to about 325 mesh (from about 74 to about 44 μm).

After the formation of said composite powder, it is desirable to cool rapidly said composite powder, and also to carry out steps from melting to the completion of pulverization of said micro-metal in a non-oxidizing atmosphere, similarly to the case of the first process of the present invention.

Subsequently, in the second process of the present invention, said assistant-powder is separated and removed from said composite powder, just as in the first process of the present invention, thereby obtaining a desired fine powder of said metal.

As a variation of the second process of the present invention, furthermore, it is possible to manufacture a finer powder of a metal with particles of more uniform shapes and having a tighter particle size distribution, by using a composite powder obtained through the above-mentioned steps before separation and removal of the assistant-powder as the starting material, adding, as required, an appropriate amount of additional assistant-powder to said composite powder, heating and melting as mentioned above, slowly cooling to solidify as mentioned above, repeating these steps, if necessary, and then, separating and removing the assistant-powder from the final composite powder thus obtained.

Moreover, as another variation of the second process of the present invention, it is possible to convert a fine powder of a metal obtained by the first process of the present invention into a finer powder of metal with particles of more uniform shapes and having a tighter particle size distribution, by using a composite powder obtained by the first process of the present invention before separation and removal of the assistant-powder as the starting material, adding, as required, an appropriate amount of additional assistant-powder to said composite powder, heating and melting as mentioned above, slowly cooling to solidify as mentioned above, and then, separating and removing the assistant-powder from the final composite powder thus obtained.

Now, the present invention is described more in detail with reference to examples. Among the examples mentioned below, Examples 1 through 5 cover embodiments based on the first process of the present invention, and Examples 6 through 9, those based on the second process of the present invention.

EXAMPLE 1

550 g of aluminum (Al) lumps to be pulverized were charged into a graphite crucible 1 placed in an electric resistance furnace 1. Said crucible 8 is rotatable around a vertical shaft 8 driven by a motor 2. Said Al in said crucible 2 was then heated by said electric resistance furnace to form molten Al at a temperature of 680° C.

Then, at the moment when the temperature of said molten Al was lowered to 670° C., 30 g of CdS powder having a particle size within a range of from about 0.1 to about 1 μm were added as the assistant-powder through a nozzle to said molten Al, while stirring said molten Al by rotating said crucible at 10 r.p.m. through the vertical shaft by the motor simultaneously with the rotation of an alumina-coated stainless steel stirrer blade rotatable through another vertical shaft by another motor for stirring at 250 r.p.m.

Said molten Al and said assistant-powder were then slowly cooled at a rate of about 0.1° C. per minute until the temperature of said molten Al was lowered to its solidus point (659° C.), while continuing said stirring so as to ensure uniform dispersion of said assistant-powder in said molten Al. And while continuing said stirring, said solidus point temperature was kept at this level. Said Al was thus fully pulverized into a fine powder.

The steps from melting up to the completion of pulverization of said Al as mentioned above were carried out in a non-oxidizing atmosphere formed by injecting argon gas through said nozzle. Stirring was effected more satisfactorily when a stirrer blade was rotated in the opposite direction to that of the graphite crucible.

The aforementioned steps resulted in the formation of a composite powder having a structure in which many particles of said assistant-powder, i.e., of CdS powder adheres to the fine powder of said Al to cover the entire surface of each particle of said fine powder. Said assistant-powder was separated by applying the conventionally known ultrasonic cleaning to said composite powder in an acetone solution, and then, removed by the conventionally known gravity concentration, thereby obtaining a fine powder of Al.

The fine powder of Al thus obtained presented spherical or various irregular shapes, had a wide particle size distribution ranging from about 10 to about 325 mesh (from about 1,651 to about 44 μm) (there were naturally present some finer particles of under 325 mesh) as represented by the shadowed portion in the figure, and showed almost no surface oxidization and pores.

The removed and recovered assistant-powder had the same shape as that at the moment of its addition not only in this Example but also in any of the Examples described hereafter, and was therefore repeatedly applicable as the assistant-powder.

EXAMPLE 2

With the use of the same apparatus as that employed in Example 1, 1,176 g of aluminum (Al) lumps and 24 g of silicon (Si) were charged into the graphite crucible. Said Al and said Si were heated by the electric resistance furnace to form a molten Al-2% Si alloy to be pulverized at a temperature of 680° C.

Then, at the moment when said molten alloy was brought into a semi-molten state, i.e., a state where solidus and liquidus phases were in coexistence, by lowering the temperature of said molten alloy 6° to 640° C., 200 g of $CoO.2Al_2O_3$ powder having a particle size within a range of from about 0.1 to about 1 μm were added as the assistant-powder through the nozzle to said semi-molten alloy, while stirring said semi-molten alloy by rotating the stirrer blade and said crucible as in Example 1.

Said semi-molten alloy and said assistant-powder were then slowly cooled at a rate of about 1° C. per minute, while continuing said stirring so as to ensure uniform dispersion of said assistant-powder in said semi-molten alloy.

Although said alloy has a eutectic point of 577° C., said alloy was fully pulverized into a fine powder at the moment when said alloy was cooled to about 630° C. Said stirring was however continued until the temperature of said alloy reached 550° C.

The above-mentioned steps from melting up to the completion of pulverization of said alloy were conducted in a non-oxidizing atmosphere as in Example 1.

These steps resulted in the formation of a composite powder having a structure in which many particles of said assistant-powder, i.e., of $CoO.2Al_2O_3$ powder adheres to the fine powder of said Al-2% Si alloy to cover the entire surface of each particle of said fine powder. Said composite powder thus obtained was then immediately transferred into another vessel for rapid cooling, and then, said assistant-powder was separated and removed from said composite powder in the same manner as in Example 1, thereby obtaining a fine powder of Al-2% Si alloy.

The fine powder of Al-2% Si alloy thus obtained has substantially the same shape and particle size distribution as those of the fine Al powder obtained in Example 1, and showed almost no surface oxidization and pores as in Example 1.

EXAMPLE 3

Copper (Cu) lumps to be pulverized in an amount of 100 g were charged into a bottom-closed silica tube with an inside diameter of 20 mmϕ together with 2 g of $Al_2O_3$ powder having a particle size within a range of from about 0.001 to about 0.006 μm as the assistant-powder. After filling said silica tube with argon gas under ⅓ atmospheric pressure, said Cu and said assistant-powder were heated to a temperature of 1,150° C. in a heating furnace to form a molten Cu.

Then, said molten Cu and said assistant-powder were slowly cooled at a rate of about 0.5° C. per minute until the temperature of said molten Cu was lowered to 1,050° C., while stirring said molten Cu by rotating said silica tube in substantially the horizontal position at 200 r.p.m. so as to ensure uniform dispersion of said assistant-powder in said molten Cu. And while continuing said stirring, said temperature was kept at this level. Said Cu was thus fully pulverized into a fine powder. With a view to achieving sufficient effects of said stirring, a plurality of projections were provided on the inner surface of said silica tube.

These steps resulted in the formation of a composite powder having a structure in which many particles of said assistant-powder, i.e., of $Al_2O_3$ powder adheres to the fine powder of said Cu to cover the entire surface of each powder of said fine powder. Then, a fine powder of Cu was obtained by separating and removing said assistant-powder from said composite powder in the same manner as in Example 1.

The fine powder of Cu thus obtained showed spherical or various irregular shapes, had a particle size distribution mostly ranging from about 150 to about 325 mesh (from about 104 to about 44 μm), and presented almost no surface oxidization and pores.

EXAMPLE 4

Lumps of Cu-13.5% Sn alloy to be pulverized in an amount of 100 g were charged into a silica tube identical with that used in Example 3 above, together with 10 g of carbon black powder having a particles size within a range of from about 0.001 to about 0.01 μm as the assistant-powder. After filling said silica tube with argon gas under ⅓ atmospheric pressure, said silica tube was vertically charged into a heating furnace and heated to a temperature of 1,050° C. to melt said alloy.

Said molten alloy and said assistant-powder were then slowly cooled at a rate of about 0.5° C. per minute until the temperature of said molten alloy was lowered to 800° C., while stirring said molten alloy by vertically shaking said silica tube at a rate of 150 times per minute in said heating furnace so as to ensure uniform dispersion of said assistant-powder in said molten alloy. And while continuing said stirring, said temperature was kept at this level. Said alloy was thus fully pulverized into a fine powder.

These steps resulted in the formation of a composite powder having a structure in which many particles of said assistant-powder, i.e., of carbon black powder adheres to the fine powder of said Cu-13.5% Sn alloy to cover the entire surface of each particle of said fine powder. Then, a fine powder of Cu-13.5% Sn alloy was obtained by separating and removing said assistant-powder from said composite powder through the application of floatation.

The fine powder of Cu-13.5% Sn alloy thus obtained had substantially the same shapes and particles size distribution as those of the fine powder of Cu obtained in Example 3 above, and showed almost no surface oxidization and pores.

EXAMPLE 5

Lumps of stainless steel (AISI No. SUS 304) to be pulverized in an amount of 500 g were charged into an alumina crucible and heated in a vacuum induction furnace to form a molten stainless steel at a temperature of 1,460° C.

Said molten stainless steel was then added with 50 g of TiN powder having a particle size within a range of from about 0.1 to about 10 μm as the assistant-powder, while stirring said molten stainless steel by rotating an alumina stirrer blade at 500 r.p.m.

Said molten stainless steel and said assistant-powder were then slowly cooled at a rate of about 10° C. per minute until the temperature of said molten stainless steel was lowered to 1,380° C., while continuing said stirring so as to ensure uniform dispersion of said assistant-powder in said molten stainless steel. And while continuing said stirring, said temperature was kept at this level. Said stainless steel was thus fully pulverized into a fine powder.

These steps resulted in the formation of a composite powder having a structure in which many particles of said assistant-powder, i.e., of TiN powder adheres to the fine powder of said stainless steel to cover the entire surface of each particle of said fine powder. Then, a fine powder of stainless steel was obtained by separating and removing said assistant-powder from said composite powder in the same manner as in Example 1.

The fine powder of stainless steel thus obtained showed spherical or various irregular shapes, had a particle size distribution mostly comprising particles of a particles size of about 100 mesh (about 147 μm), and presented almost no surface oxidization and pores.

EXAMPLE 6

The same apparatus as in Example 1, was employed. Lumps of aluminum (Al) to be pulverized in an amount of 550 g were charged into the graphite crucible. Said Al was heated in the electric resistance furnace to form molten Al at a temperature of 680° C.

Then, at the moment when the temperature of said molten Al was lowered to 670° C., 30 g of CdS powder having a particle size within a range of from about 0.1 to about 1 μm serving were added as the assistant-powder through the nozzle to said molten Al, while stirring said molten Al by rotating the stirrer blade and said crucible in the same manner as in Example 1.

Said molten Al and said assistant-powder were then slowly cooled at a rate of about 0.1° C. per minute until the temperature of said molten Al was lowered to its solidus point (659° C.), while continuing said stirring so as to ensure uniform dispersion of said assistant-powder in said molten Al. And, while continuing said stirring, said solidus point temperature was kept at this level. Said Al was thus fully pulverized into a fine powder.

These steps resulted in the formation of a primary composite powder having a structure in which many particles of said assistant-powder, i.e, of CdS powder adheres to the fine powder of said Al to cover the entire surface of each particle of said fine powder. (The steps mentioned above were based on the first process of the present invention.)

Then, after the temperature of said primary composite powder was lowered to 650° C. while continuing said stirring, 20 g of CdS powder having a particles size within a range of from about 0.1 to about 1 μm were further added as the assistant-powder.

Said primary composite powder and said assistant-powder were then again heated to 665° C. at a rate of 1° C. per minute by said electric resistance furnace 1 while continuing said stirring, to bring said Al contained in said primary composite powder into a molten state.

Said Al and said assistant-powder were then slowly cooled again at a rate of about 0.1° C. per minute, while continuing said stirring, until the temperature of said Al reached its solidus point. And, while still continuing said stirring, said solidus point temperature was kept at this level. Said Al was thus fully pulverized into a finer powder.

These steps resulted in the formation of a secondary composite powder having a structure in which many particles of said assistant-powder, i.e., of CdS powder adheres to the fine powder of said Al to cover the entire surface of each particle of said fine powder.

After the temperature of said secondary composite powder was lowered to 630° C. while continuing said stirring, said secondary composite powder was transferred into another vessel for rapid cooling.

The aforementioned steps from melting up to pulverization of said Al were conducted in a non-oxidizing atmosphere of argon gas in the same manner as in Example 1.

Then, a fine powder of Al was obtained by separating and removing said assistant-powder from said secondary composite powder in the same manner as in Example 1.

The fine powder of Al thus obtained had a tight particle size distribution mostly comprising very small particles of from about 200 to about 325 mesh (from about 74 to about 44 μm) as shown in the figure, with almost uniform shapes and showed almost no surface oxidation and pores. As is clear also from the figure, furthermore, the particles sizes of the fine powder of Al obtained by the second process of the present invention were further smaller and more uniform than those of the fine powder of Al obtained by the first process of the present invention.

EXAMPLE 7

Copper (Cu) shots to be pulverized having a particle size within a range of from about 3 to about 5 mm in an amount of 100 g were charged into a silica tube identical with that used in Example 3, together with 3 g of an $Al_2O_3$ powder, serving as the assistant-powder, having a particle size within a range of from about 0.001 to about 0.006 μm, and argon gas was filled under ⅓ atmospheric pressure. Said Cu shots were then melted by heating to a temperature of 1,100° C. in a heating furnace, while stirring said Cu shots and said assistant-powder by rotating said silica tube in substantially the horizontal position at 200 r.p.m. in said heating furnace so as to ensure uniform mixing of said Cu shots and said assistant-powder.

Then, while continuing said stirring, said molten Cu shots and said assistant-powder were slowly cooled at a rate of about 0.5° C. per minute until the temperature of said molten Cu shots was lowered to 1,050° C. And, while still continuing said stirring, said temperature was kept at this level. Said Cu shots were thus fully pulverized into a fine powder.

These steps resulted in the formation of a composite powder having a structure in which many particles of said assistant-powder, i.e., of $Al_2O_3$ powder adheres to the fine powder of said Cu to cover the entire surface of each particle of said fine powder. Then, a fine powder of Cu was obtained by separating and removing said assistant-powder from said composite powder in the same manner as in Example 1.

The fine powder of Cu thus obtained has a tight particle size distribution mostly comprising very small and uniform particles of from about 200 to about 325 mesh (from about 74 to about 44 μm) and showed almost no surface oxidization and pores.

EXAMPLE 8

Chips of a Cu-13.5% Sn alloy to be pulverized in an amount of 100 g were charged into a silica tube identical with that used in Example 3, together with 10 g of carbon black powder having a particle size within a range of from about 0.001 to about 0.01 μm as the assistant-powder, and said silica tube was filled with argon gas under ⅓ atmospheric pressure. Said silica tube was then vertically charged into a heating furnace. Said chips were melted by heating to a temperature of 1,050° C. while stirring said chips and said assistant-powder by vertically shaking said silica tube at a rate of 150 times per minute so as to ensure uniform mixing of said chips and said assistant-powder.

Said molten chips and said assistant-powder were then slowly cooled at a rate of about 0.5° C. per minute, while continuing said stirring, until the temperature of said chips was lowered to 800° C. And, while still continuing said stirring, said temperature was kept at this level. Said chips were thus fully pulverized into a fine powder.

These steps resulted in the formation of a primary composite powder having a structure in which many particles of said assistant-powder, i.e., of carbon black powder adheres to the fine powder of said Cu-13.5% Sn alloy to cover the entire surface of each particle of said fine powder.

Then, while still continuing said stirring, 10 g of carbon black powder having a particle size within a range of from about 0.001 to about 0.01 μm were further added as the assistant-powder.

Said primary composite powder and said assistant-powder were then again heated to 900° C. by said heating furnace while continuing said stirring, to bring said alloy contained in said primary composite powder into a semi-molten state, and then slowly cooled again in the same manner as described above. Said alloy was thus fully pulverized into a finer powder.

These steps resulted in the formation of a secondary composite powder having a structure in which many particles of said assistant-powder, i.e., of carbon black powder adheres to the fine powder of said Cu-13.5% Sn alloy to cover the entire surface of each particle of said fine powder.

A fine powder of Cu-13.5% Sn alloy was then obtained by separating and removing said assistant-powder from said secondary composite powder in the same manner as in Example 4.

The fine powder of Cu-13.5% Sn alloy thus obtained had a tight particle size distribution mostly comprising very small and uniform particles of from about 200 to about 325 mesh (from about 74 to about 44 μm) and showed almost no surface oxidization and pores.

EXAMPLE 9

Chips of a stainless steel (AISI No. SUS 304) to be pulverized in an amount of 500 g were charged in an alumina crucible, together with 70 g of TiN powder having a particle size within a range of from about 0.1 to about 10 μm as the assistant-powder. Said alumina crucible was then charged into a vacuum induction furnace. Said chips were then melted by heating to a temperature of 1,420° C. in said furnace, while stirring said chips and said assistant-powder by rotating an alumina stirring blade at 500 r.p.m. so as to ensure uniform mixing of said chips and said assistant-powder.

Said chips and said assistant-powder were then slowly cooled at a rate of about 10° C. per minute, while continuing said stirring, until the temperature of said chips was lowered to 1,380° C. And, while still continuing said stirring, said temperature was kept at this level. Said chips were thus fully pulverized into a fine powder.

These steps resulted in the formation of a composite powder having a structure in which many particles of said assistant-powder, i.e., of TiN powder adheres to the fine powder of said stainless steel to cover the entire surface of each particle of said fine powder. A fine powder of stainless steel was then obtained by separating and removing said assistant-powder from said composite powder in the same manner as in Example 1.

The fine powder of stainless steel thus obtained had a tight particle size distribution mostly comprising very small and uniform particles of from about 200 to about 325 mesh (from about 74 to about 44 μm) and showed almost no surface oxidization and pores.

According to the process of the present invention, as described above in detail, it is possible to efficiently manufacture by simple operations at lower costs a fine powder of a metal having spherical or various irregular shapes with almost uniform particle sizes and showing excellent properties free from surface oxidization and pores, thus providing industrially useful effects.

What is claimed is:

1. A process for manufacturing a fine powder of a metal, characterized by the steps of:

admixing a metal in at least a semi-molten state, which is to be pulverized, in a vessel with an assistant-powder, said assistant-powder consisting of a material which has a higher melting point than said metal and is difficult to chemically react with said metal and/or difficult to form a solid solution with said metal, and the temperature of said at least semi-molten metal being lower than the melting point of said assistant-powder;

mixing said at least semi-molten metal and said assistant-powder by stirring so as to ensure uniform dispersion of said assistant-powder in said at least semi-molten metal;

slowly cooling said at least semi-molten metal and said assistant-powder, while continuing said stirring, until the temperature of said at least semi-molten metal reaches at least its solidus point, to pulverize said metal into a fine powder and to form a composite powder having a structure in which said assistant-powder adheres to said fine powder to cover the entire surface of each particle of said fine powder; and then, separating and removing said assistant-powder from said composite powder, thereby obtaining a fine powder of said metal.

2. The process as claimed in claim 1, wherein said assistant-powder has a particle size within a range of from about 0.001 to about 10 μm and comprises at least one powder selected from the group consisting of:

(a) MgO, $Al_2O_3$, $Al_2Si_2O_7$ (Kaolinite), $SiO_2$, CaO, $TiO_2$, $Cr_2O_3$, MnO, $Fe_3O_4$, $CoO.Al_2O_3$, $Cu_2O$, ZnO, SrO, $ZrO_2$, CdO, $SnO_2$, $Sb_2O_3$, BaO, $La_2O_3$, $CeO_2$, PbO and $Pb_3O_4$ powder;

(b) $B_4C$, TiC, ZrC, TaC and WC powder;

(c) BN, AlN, $Si_3N_4$ and TiN powder;

(d) Ti (CN) and Ti (CNO) powder;

(e) CaS, ZnS, CdS, xCdS.yCdSe and $Sb_2S_3$ powder;

(f) $AlB_2$, $Fe_2B$, $Ni_2B$ and NbB powder; and (g) carbon black and graphite powder.

3. The process as claimed in claim 1, wherein a metal in solid state, which is to be pulverized, is charged in said vessel, and said metal is heated until said metal reaches at least a semi-molten state, and then, said assistant-powder is added to said at least semi-molten metal, thereby admixing said at least semi-molten metal and said assistant-powder in said vessel.

4. The process as claimed in claim 2, wherein a metal in solid state, which is to be pulverized, is charged in said vessel, and said metal in heated until said metal reaches at least a semi-molten state, and then, said assistant-powder is added to said at least semi-molten metal, thereby admixing said at least semi-molten metal and said assistant-powder in said vessel.

5. The process as claimed in claim 1, wherein a metal in solid state, which is to be pulverized, is charged in said vessel together with said assistant-powder, and then, said metal and said assistant-powder are heated until said metal reaches at least a semi-molten state, thereby admixing said at least semi-molten metal and said assistant-powder in said vessel.

6. The process as claimed in claim 2, wherein a metal in solid state, which is to be pulverized, is charged in said vessel together with said assistant-powder, and then, said metal and said assistant-powder are heated until said metal reaches at least a semi-molten state, thereby admixing said at least semi-molten metal and said assistant-powder in said vessel.

7. The process as claimed in claim 1, wherein a metal in at least semi-molten state, which is to be pulverized, is charged in said vessel, and then, said assistant-powder is added to said at least semi-molten metal, thereby admixing said at least semi-molten metal and said assistant-powder in said vessel.

8. The process as claimed in claim 2, wherein a metal in at least semi-molten state, which is to be pulverized, is charged in said vessel, and then, said assistant-powder is added to said at least semi-molten metal, thereby admixing said at least semi-molten metal and said assistant-powder in said vessel.

9. The process as claimed in claim 1, wherein, following the melting and refining steps of a metal, which is to be pulverized, in said vessel, said assistant-powder is added to said metal still in at least a semi-molten state in said vessel, thereby admixing said at least semi-molten metal and said assistant-powder in said vessel.

10. The process as claimed in claim 2, wherein, following the melting and refining steps of a metal, which is to be pulverized, in said vessel, said assistant-powder is added to said metal still in at least a semi-molten state in said vessel, thereby admixing said at least semi-molten metal and said assistant-powder in said vessel.

11. The process as claimed in claim 1, wherein said slow cooling is conducted at a cooling rate within a range of from 0.1° to 10° C. per minute.

12. The process as claimed in claim 2, wherein said slow cooling is conducted at a cooling rate within a range of from 0.1° to 10° C. per minute.

13. The process as claimed in claim 3, wherein said slow cooling is conducted at a cooling rate within a range of from 0.1° to 10° C. per minute.

14. The process as claimed in claim 4, wherein said slow cooling is conducted at a cooling rate within a range of from 0.1° to 10° C. per minute.

15. The process as claimed in claim 5, wherein said slow cooling is conducted at a cooling rate within a range of from 0.1° to 10° C. per minute.

16. The process as claimed in claim 6, wherein said slow cooling is conducted at a cooling rate within a range of from 0.1° to 10° C. per minute.

17. The process as claimed in claim 7, wherein said slow cooling is conducted at a cooling rate within a range of from 0.1° to 10° C. per minute.

18. The process as claimed in claim 8, wherein said slow cooling is conducted at a cooling rate within a range of from 0.1° to 10° C. per minute.

19. The process as claimed in claim 9, wherein said slow cooling is conducted at a cooling rate within a range of from 0.1° to 10° C. per minute.

20. The process as claimed in claim 10, wherein said slow cooling is conducted at a cooling rate within a range of from 0.1° to 10° C. per minute.

21. A process for manufacturing a fine powder of metal, characterized by the steps of:

charging a micro-metal in a solid state, which is to be pulverized, into a vessel together with an assistant-powder, said assistant-powder consisting of a material which has a higher melting point than said metal and is difficult to chemically react with said metal and/or difficult to form a solid solution with said metal;

stirring said micro-metal and said assistant-powder so as to ensure uniform mixing of said micro-metal and said assistant-powder;

heating said micro-metal and said assistant-powder, while continuing said stirring, until said micro-metal reaches at least a semi-molten state, the temperature of said at least semi-molten micro-metal being lower than the melting point of said assistant-powder;

slowly cooling said at least semi-molten micro-metal and said assistant-powder, while continuing said stirring, until the temperature of said at least semi-molten micro-metal reaches at least its solidus point, to pulverize said micro-metal into a fine powder and to form a composite powder having a structure in which said assistant-powder adheres to said fine powder to cover the entire surface of each particle of said fine powder; and then, separating and removing said assistant-powder from said composite powder, thereby obtaining a fine powder of said metal.

22. The process as claimed in claim 21, wherein said assistant-powder has a particle size within a range of from about 0.001 to about 10 μm and comprises at least one powder selected from the group consisting of:

(a) $MgO$, $Al_2O_3$, $Al_2Si_2O_7$ (Kaolinite), $SiO_2$, $CaO$, $TiO_2$, $Cr_2O_3$, $MnO$, $Fe_3O_4$, $CoO.2Al_2O_3$, $Cu_2O$, $ZnO$, $SrO$, $ZrO_2$, $CdO$, $SnO_2$, $Sb_2O_3$, $BaO$, $La_2O_3$, $CeO_2$, $PbO$ and $Pb_3O_4$ powder;

(b) $B_4C$, $TiC$, $ZrC$, $TaC$ and $WC$ powders;

(c) $BN$, $AlN$, $Si_3N_4$ and $TiN$ powder;

(d) Ti (CN) and Ti (CNO) powder;

(e) $CaS$, $ZnS$, $CdS$, $xCdS.yCdSe$ and $Sb_2S_3$ powder;

(f) $AlB_2$, $Fe_2B$, $Ni_2B$ and $NbB$ powder; and (g) carbon black and graphite powder.

23. The process as claimed in claim 21, wherein there is used, as said micro-metal, a composite powder having a structure in which said assistant-powder adheres to a fine powder of a metal to cover the entire surface of each particle of said fine powder.

24. The process as claimed in claim 22, wherein there is used, as said micro-metal, a composite powder having a structure in which said assistant-powder adheres to a fine powder of a metal to cover the entire surface of each particle of said fine powder.

25. The process as claimed in claim 21, wherein said slow cooling is conducted at a cooling rate within a range of from 0.1° to 10° C. per minute.

26. The process as claimed in claim 22, wherein said slow cooling is conducted at a cooling rate within a range of from 0.1° to 10° C. per minute.

27. The process as claimed in claim 23, wherein said slow cooling is conducted at a cooling rate within a range of from 0.1° to 10° C. per minute.

28. The process as claimed in claim 24, wherein said slow cooling is conducted at a cooling rate within a range of from 0.1° to 10° C. per minute.

* * * * *

UNITED STATES PATENT AND TRADEMARK OFFICE

CERTIFICATE OF CORRECTION

PATENT NO. : 4,202,686

DATED : May 13, 1980

INVENTOR(S) : TAIZO OHMURA et al

It is certified that error appears in the above-identified patent and that said Letters Patent are hereby corrected as shown below:

Column 6, line 21: before "hereinafter", replace "in" with ---is---.

Column 8, line 17: after "crucible", delete "1".

Column 8, line 18: after "furnace", delete "1".

Column 8, line 18: after "crucible", delete "8".

Column 8, line 19: after "shaft", delete "8".

Column 8, line 19: after "motor", delete "2".

Column 8, line 20: after "crucible", delete "2".

Column 14, line 51 (Claim 2): replace "$CoO.Al_2O_3$" with ---$CoO.2Al_2O_3$---.

Column 15, line 1(Claim 4): after "metal", replace "in" with ---is---.

Column 16, line 4 (Claim 21): after "powder of", insert

Signed and Sealed this

Eighteenth Day of November 198

[SEAL]

Attest:

SIDNEY A. DIAMOND

Attesting Officer

Commissioner of Patents and Tradema